US010205244B2

(12) United States Patent
Tatomirescu et al.

(10) Patent No.: US 10,205,244 B2
(45) Date of Patent: Feb. 12, 2019

(54) PLATFORM INDEPENDENT ANTENNA

(71) Applicant: Intel IP Corporation, Santa Clara, CA (US)

(72) Inventors: Alexandru Daniel Tatomirescu, Aalborg (DK); Poul Olesen, Stoevring (DK); Peter Bundgaard, Aalborg (DK); Pevand Bahramzy, Norresundby (DK); Mikael Bergholz Knudsen, Gistrup (DK); Gert Perdersen, Storvorde (DK); Emil Buskgaard, Aalborg (DK); Mauro Pelosi, Aalborg (DK); Samantha Caporal Del Barrio, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 391 days.

(21) Appl. No.: 14/134,632

(22) Filed: Dec. 19, 2013

(65) Prior Publication Data

US 2015/0180123 A1 Jun. 25, 2015

(51) Int. Cl.

| | |
|---|---|
| ***H01Q 5/00*** | (2015.01) |
| ***H01Q 9/42*** | (2006.01) |
| ***H01Q 5/371*** | (2015.01) |
| ***H01Q 23/00*** | (2006.01) |
| ***H01Q 13/10*** | (2006.01) |

(52) U.S. Cl.
CPC ..... *H01Q 9/42* (2013.01); *H01Q 5/371* (2015.01); *H01Q 13/103* (2013.01); *H01Q 23/00* (2013.01)

(58) Field of Classification Search
CPC ..... H01Q 9/42; H01Q 5/371; H01Q 23/00; H01Q 13/103
See application file for complete search history.

(56) References Cited

U.S. PATENT DOCUMENTS

| | | | | |
|---|---|---|---|---|
| 2007/0268191 | A1* | 11/2007 | Ishizuka | H01Q 1/243 343/702 |
| 2007/0285321 | A1* | 12/2007 | Chung | H01Q 5/371 343/702 |
| 2009/0033561 | A1* | 2/2009 | Pros | H01Q 9/42 343/700 MS |
| 2011/0237207 | A1 | 9/2011 | Bauder | |
| 2013/0162497 | A1 | 6/2013 | Satou et al. | |
| 2013/0257674 | A1 | 10/2013 | Li et al. | |
| 2017/0077599 | A1 | 3/2017 | Sayama et al. | |
| 2017/0187113 | A1 | 6/2017 | Svendsen | |

* cited by examiner

*Primary Examiner* — Jessica Han
*Assistant Examiner* — Michael Bouizza
(74) *Attorney, Agent, or Firm* — Schiff Hardin LLP

(57) ABSTRACT

Described herein are architectures, platforms and methods for electrically tuning radiators in a portable device. The electrical tuning implements platform independent radiating elements or antennas in a portable device.

15 Claims, 4 Drawing Sheets

PLATFORM INDEPENDENT ANTENNA

BACKGROUND

With an increased demand in data rate for mobile applications, the number of frequency bands required to be supported by one portable device has increased as well. For example, even though the size of platforms may have increased from a "candy bar" shape of 100×40 mm to a larger "smart phone" size 120×55 mm, the volume allocated for the antenna may not have increased. In the lower frequency bands such as GSM 850, 900, UMTS Band VIII and countless other bands for LTE, the whole chassis of the portable device may be used for radiating purposes. Therefore, the smaller chassis may not adequately support the lower frequency bands.

An antenna element may be used as a coupler to a printed circuit board (PCB) ground plane in order to maximize an impedance bandwidth. The limiting factor in the antenna bandwidth is the limited volume available for the antenna, especially at higher frequencies. The fundamental limit calculated for the antenna with a size similar to a typical smart phone may be much higher than what had been achieved in previous smaller chassis sizes. This is mainly due to the various design constraints imposed such as the integration of other components in the portable device (e.g., speaker, vibrator or camera).

The size and shape of the ground plane may affect the radiation performance of the different types of antennas in different portable devices. To this end, from a manufacturing and design perspective, it is highly desirable to have an antenna topology that can be used across platforms.

BRIEF DESCRIPTION OF THE DRAWINGS

The detailed description is described with reference to accompanying figures. In the figures, the left-most digit(s) of a reference number identifies the figure in which the reference number first appears. The same numbers are used throughout the drawings to reference like features and components.

DETAILED DESCRIPTION

Described herein are architectures, platforms and methods for implementing a platform independent radiating element or antenna or in a portable device. For example, feeding of the radiating element, such as a monopole antenna through electromagnetic coupling may limit the role of a ground plane with regard to radiation properties of the monopole antenna. In this example, the limited role (i.e., electrical effects) of the ground plane (e.g., metallic or any conductive chassis) may facilitate the monopole antenna to have dual resonant characteristics based on its own shape and configurations. In other words, the dual resonant characteristic is obtained independent of size and configurations of the ground plane in the portable device. To this end, the antenna (e.g., monopole antenna) becomes a platform independent radiating element or antenna.

As described in present implementations herein, a radiating element includes two or more arms or radiators that are connected to a ground plane; a feed-point; and a tuning capacitor. The feed-point is coupled electromagnetically with the radiating element and particularly, to one of the arms or radiators through an electromagnetic coupling. In this configuration, the feed-point indirectly feeds the monopole antenna.

The indirect feeding may minimize the role of the ground plane in the radiation properties of the monopole antenna because minimal current is induced at the ground plane. This minimal current is particularly present when the monopole antenna is designed to have a high Q. The Q in this case is a measure of stored energy and a measure of the bandwidth of the monopole antenna relative to center frequency of the bandwidth.

For example, the high Q monopole antenna limits magnitudes of currents running or induced into the ground plane. In this example, an amount of stored energy is proportional to the high Q and as such, near-field energy is stored in a smaller volume. The smaller volume limits electrical effects of the ground plane and other components to the radiating properties of the monopole antenna. In other words, the resonant frequencies seen at the feeding point are defined by configuration of the arms or radiators, and are independent of the size or shape of the ground plane (e.g., device chassis).

In an exemplary implementation, the tuning capacitor facilitates dual resonant frequency characteristics of the radiating element (e.g., monopole antenna). For example, an arm or radiator of the radiating element (e.g., monopole antenna) is coupled to the tuning capacitor in order to resonate at a resonant frequency. In this example, the resonant frequency may differ from another resonant frequency in the radiating element (e.g., monopole antenna) in order to generate dual resonant frequency characteristics.

Figure 1:
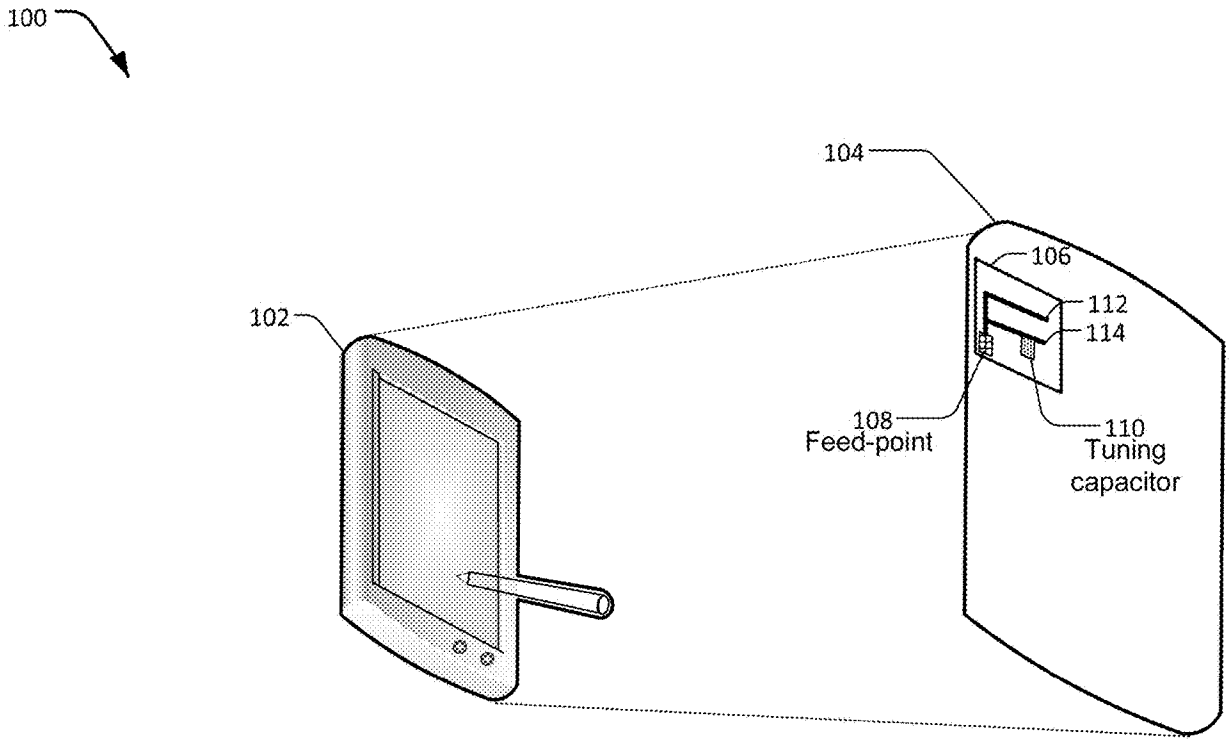
FIG. 1 is an example overview of components in a portable device as described in present implementations herein.

FIG. 1 is an example overview 100 showing components in a portable device as described in present implementations herein. The overview 100 illustrates a portable device 102, a chassis 104, and a monopole antenna 106. The monopole antenna 106 is considered as a radiating element. The overview 100 further shows components of the monopole antenna 106 such as a feed-point 108 and a tuning capacitor 110. The monopole antenna 106 further includes an arm or radiator 112 and another arm or radiator 114.

The portable device 102 may include, but is not limited to, a tablet computer, a netbook, a notebook computer, a laptop computer, mobile phone, a cellular phone, a smartphone, a personal digital assistant, a multimedia playback device, a digital music player, a digital video player, a navigational device, a digital camera, and the like. The portable device 102, for example, may communicate with another portable device (not shown) in a network environment. The network environment, for example, includes a cellular network configured to facilitate communications between the portable device 102 and the other portable device.

As an example of present implementation herein, the portable device 102 utilizes the monopole antenna 106 in communicating with another portable device. The monopole antenna 106 may be considered a radiating element. The monopole antenna 106 may be built from copper or any other conductive traces printed on an FR4 printed circuit board (PCB) or any other material or three dimensional (3D)

surface. Furthermore, the monopole antenna 106 may be configured to include radiators of different shapes and/or configurations with similar radiation mechanism, such as PIFA's, Printed monopoles on 3D structures, wire antennas etc.

For example, the monopole antenna 106 may include two arms or radiators 112 and 114 that are symmetric or non-symmetric with one another. In another example, the monopole antenna 106 may include one radiator (e.g., one of arms or radiators 112 and 114) with a square shape, a circular shape, etc. while the other radiator (e.g., one of arms or radiators 112 and 114) is a plain strip of coil antenna with a different physical length and size. In these examples, the available space in the portable device 102 may dictate the shape and size of the monopole antenna 106.

With continuing reference to FIG. 1, the chassis 104 may act as a ground plane for the monopole antenna 106. In PCBs, the ground plane is an area of the copper traces that is connected to a power supply ground terminal. Furthermore, the ground plane may serve as a return part for current from different components that are connected or mounted on the PCB.

In an exemplary implementation, the chassis 104 is configured to be of a minimal factor (i.e., lesser electrical effect) with regard to radiation properties of the monopole antenna 106. For example, the chassis 104 has a minimal or no electrical effect on antenna bandwidth, antenna Q, near-field radiation, far-field radiation, etc. of the monopole antenna 106. In this example, the monopole 106 may become platform independent and its radiation properties are dictated by its own configuration and shapes. In other words, the shapes and/or sizes of the chassis 104 may not be a factor in the radiation properties of the monopole antenna 106. As further discussed below, feeding of the monopole antenna 106 through an electromagnetic coupling may facilitate this electrical effect on the chassis 104.

For example, with the use of electromagnetic coupling, the monopole antenna 106 has a radiator with a resonance frequency based on its own shape, configuration and coupling to the feeding element. In this example, there is no need to configure the chassis 104 to generate in-phase signals when reflecting radiation of the above radiator. In other words, the chassis 104 may not dictate antenna characteristics of the radiator of the monopole antenna 106.

In another example, during receiving, the monopole antenna 106 has a radiator that is configured to receive signals based on its own configuration and shape (e.g., meandered radiator). In this example, there is no need to configure the chassis 104 to guide received signals from the monopole antenna 106 into to a transceiver module (not shown).

In an exemplary implementation, the feed-point 108 is disposed in a manner that it indirectly feeds the monopole antenna 106. For example, the feed-point 108 is electromagnetically coupled to the monopole antenna 106 by disposing one end of the monopole antenna 106 close to a location of the feed-point 108. In this example, an indirect feeding is implemented through the electromagnetic coupling between the feed-point 108 and the one end of the monopole antenna 106. The indirect feeding minimizes induced currents in the chassis 104 (i.e., ground plane) and as such, the chassis 104 will have minimal electrical effects on the radiation properties of the monopole antenna 106. Furthermore, the indirect feeding minimizes electrical effects of other components or metallic mechanical parts of the portable device 102.

The tuning capacitor 110 is an active impedance matching component in order to facilitate dual resonance frequency characteristics of the monopole antenna 106. For example, the tuning capacitor 110 is adjusted in order for the monopole antenna 106 to resonate at a certain resonant frequency. In this example, the certain resonant frequency may increase antenna bandwidth of the monopole antenna 106.

Although the overview 100 illustrates in a limited manner basic components of a transceiver circuitry in the portable device 102, other components such as battery, one or more processors, SIM card, etc. were not described in order to simplify the embodiments described herein.

Figure 2:
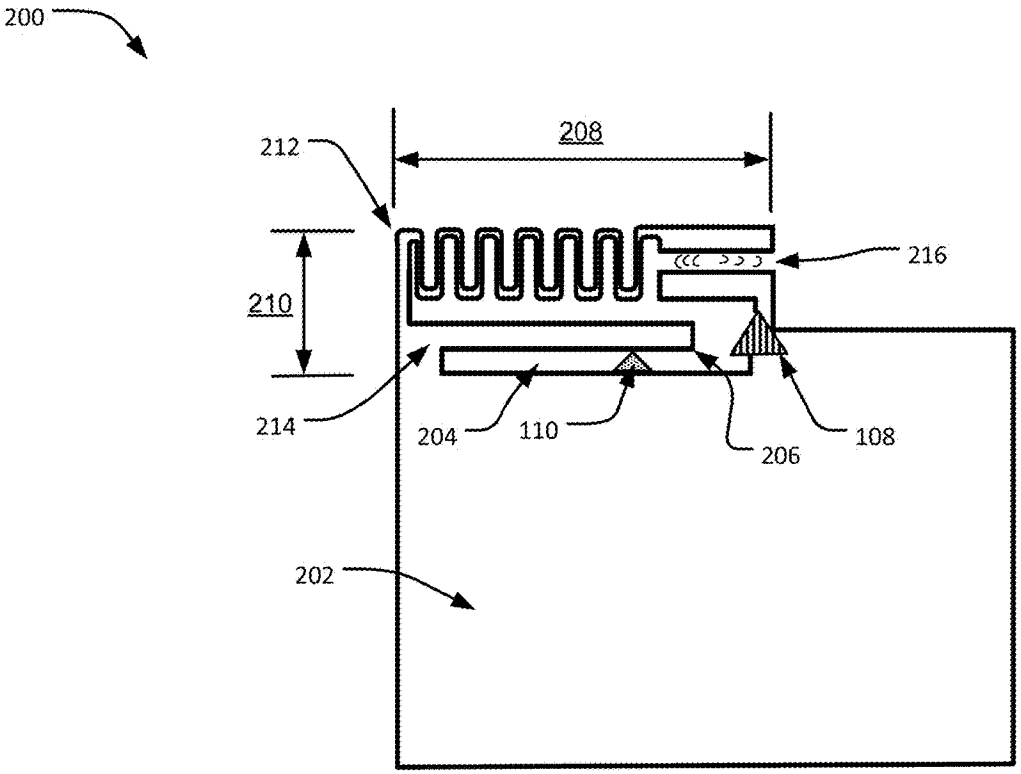
FIG. 2 is an example apparatus that is configured to implement a platform independent radiating element as described in present implementations herein.

FIG. 2 illustrates an example platform independent radiating element 200 that may be configured to be implemented in a portable device. The radiating element 200 may be implemented as the monopole antenna 106 of FIG. 1, and includes feed-point 108, tuning capacitor 110, a ground plane 202, a longitudinal slot 204, a second radiator tip 206, an antenna length 208, and an antenna width 210. Furthermore, an electromagnetic coupling 212 illustrates transfer of electrical energies from the feed-point 108 to the radiating element 200.

In an exemplary implementation, the tuning capacitor 110 may be disposed closer to the tip of the radiator 214. At this location, a trade-off between losses and minimum current is selected based upon the desired bandwidth. Furthermore, the value of the tuning capacitor 110 is a factor with regard to its distance from the radiator tip 206.

As an example of present implementations herein, the radiating element 200 is an inverted-L-antenna (ILA) and it includes a radiator 212 that is coupled or combined with another radiator 214 to form a parallel oscillating path. For example, the radiator 212 is meandered in shape and extends from left to right in direction. In this example, the radiator 212 extends from left to right in a winding course and its physical antenna length is defined by the antenna length 208. However, with the meandering shape, the radiator 212 increases its electrical length. As to be understood, other implementations may increase electrical length of the radiator 212, such as being loaded with dielectric or magnetic material, "lumping" or stacking components, or by "folding over" the radiator 212. All such exemplary implementations may increase the electrical length of the radiator 212 without adding to the actual volume taken up by radiator 212. The increased electrical length may facilitate the radiator 212 to resonate at a first resonant frequency. The first resonant frequency, for example, is at low frequency range.

As shown, one end of the radiator 212 is electromagnetically coupled to the feed-point 108. Electromagnetic coupling 216, for example, illustrates the transfer of electrical energies during loading of the radiating element 200. The transfer of electrical energies may be defined, for example, by an electromagnetic response between the feed-point 108 and the radiator 212.

In an implementation, the radiator 214 may form a plain straight strip monopole and is disposed in parallel with a longitudinal direction of the radiator 212. Depending upon the bandwidth desired for the radiating element 200, a coupling factor in between the radiators 212 and 214 may be adjusted. For example, with the configuration above, the first resonant frequency may be moved from one low frequency range to another low frequency range by changing the shape of the meandered radiator 212, size of the antenna width 210, antenna length 208, and/or position of the radiator 106-4. In other words, different kind of embodiments in the physical structure and configurations of the radiating element 200 may result to different resonant frequencies in the radiating element 200.

With continuing reference to FIG. 2, the tuning capacitor 110 is disposed in the longitudinal slot 204. The longitudinal slot 204 is a space in between the ground plane 202 and the radiator 214. The longitudinal slot 204, when combined with the tuning capacitor 110, is utilized as a tank circuit in order to obtain a second resonant frequency for the monopole antenna 106. The obtaining of the second resonant frequency may increase operating bandwidth of the monopole antenna 106. For example, adjusting the tuning capacitor 110 may generate more than 35 MHz of bandwidth at any given time. In this example, a tuning range of the monopole antenna 106 may be increased by enlarging interval of capacitance in the tuning capacitor 110.

In an exemplary implementation, the tuning capacitor 110 may be tuned from 1.6 pF to 2.7 pF to complement the electromagnetic response in between the feed-point 108 and the radiator 106-2. In this implementation, the electrical effects of the ground plane 202 may not affect or it may be of minimal factor in the radiation properties of the monopole antenna 106. The reason being, the use of electromagnetic coupling at the feed-point 108 eliminates or minimizes amount of induced currents at the ground plane 202. As such, regardless of the size of the ground plane 202, the radiation properties of the monopole antenna 106 is barely or not electrically affected at all.

In an exemplary implementation, the feed-point 108 may further include a capacitive coupling in order to reduce the electrical length of the monopole antenna 106. Furthermore, the meandering of the radiator 106-2 may further reduce the electrical length of the monopole antenna 106. Although not shown in the apparatus 200, the apparatus 200 may further utilize other reactive components for impedance matching and/or adjusting of the electrical length.

Figure 3:
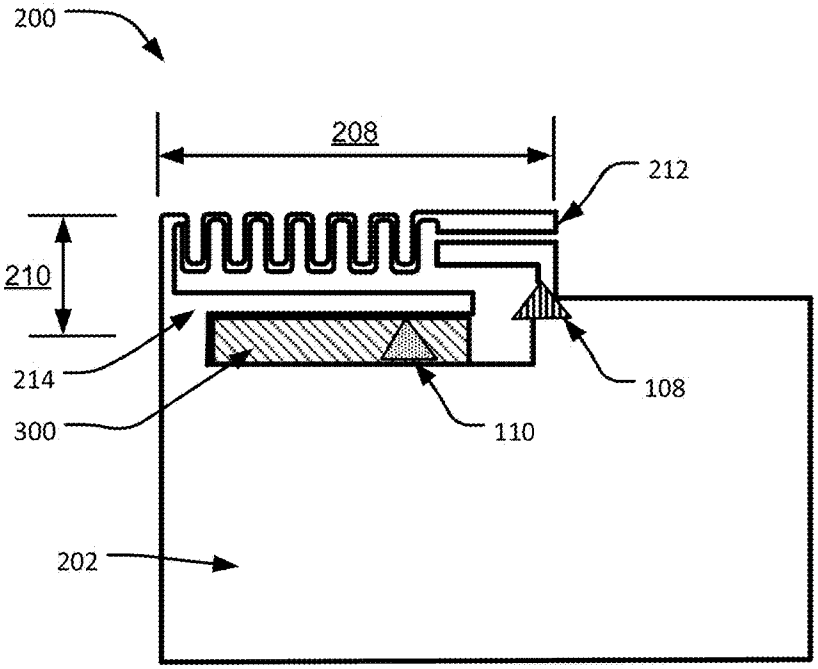
FIG. 3 is another embodiment configured to implement a platform independent radiating element as described in present implementations herein.

FIG. 3 illustrates another embodiment of the apparatus 200 that is configured to implement platform independent miniaturized antenna in a portable device. As shown, the apparatus 200 includes a space or an area 300, which may be a milled area, in between the radiator 214 and the ground plane 202. The area 300 cover the longitudinal slot 204 as previously discussed in FIG. 2.

In an exemplary implementation, the area 300 may be created by removing areas of a PCB material through a milling process. For example, multiple individual cuts on a single run are utilized to form the longitudinal slot 204. In this example, the resulting area 300 may minimize dielectric losses in areas where strong electrical field strength is present.

As shown, the area 300 further facilitates the radiating element 200 to be independent of the size and configuration of the ground plane 202. In other words, the ground plane 202 will have minimal electrical effect on the radiation properties of the radiating element 200.

Figure 4:
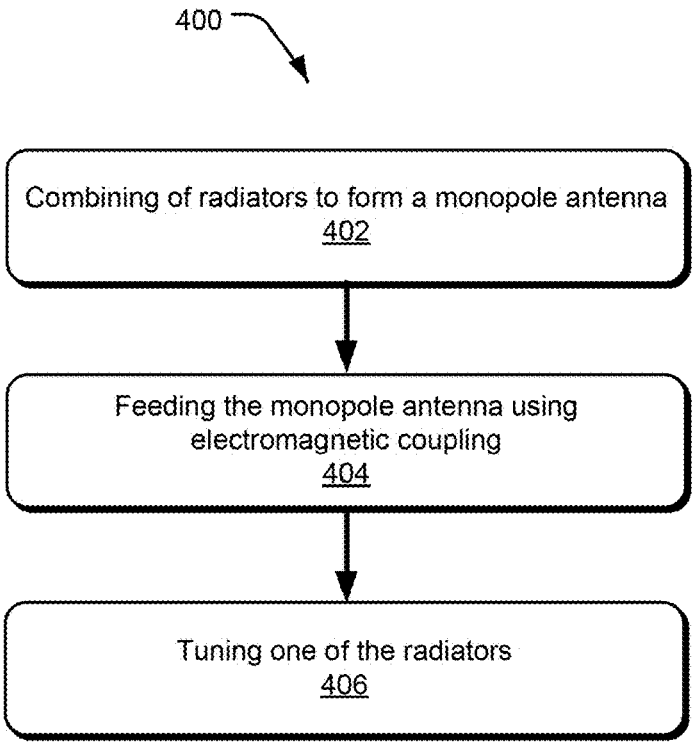
FIG. 4 is an example process chart illustrating an example method for electrically tuning radiators to implement a platform independent radiating element in a portable device.

FIG. 4 shows an example process chart 400 illustrating an example method for electrically tuning radiators in an antenna to implement platform independent miniaturized antenna in a portable device. The order in which the method is described is not intended to be construed as a limitation, and any number of the described method blocks can be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At block 402, combining of radiators to form a monopole antenna is performed. For example, two radiators 212 and 214 are combined to form a radiating element 200. In this example, the radiator 212 is a meandered monopole of different shapes or geometry such as a continuous curve, spiral, square, etc. The meandering of the radiator 212 is implemented to increase its electrical length. As discussed, there are other implementations that increase electrical length without increasing volume of the radiator 212. For example, a physical geometry of the meandered radiator 212 resonates at a first resonant frequency. The first resonant frequency, for example, may include a low frequency range.

On the other hand, the radiator 214 may include a straight strip of radiator that is separated from a ground plane through a longitudinal slot (e.g., longitudinal slot 204). The radiator 214 may be tuned to resonate at a second resonant frequency in order to extend instantaneous system bandwidth of the radiating element 200. This way, stringent requirements of carrier aggregation in wireless communications is met.

At block 404, feeding the monopole antenna using electromagnetic coupling is performed. For example, a feed-point 108 is coupled to the monopole antenna 106 and particularly, to the radiator 212 through an electromagnetic coupling 216. In this example, the feed-point 108 indirectly feeds the monopole antenna 106. The indirect feeding may minimize the role of the ground plane 202 in the radiation properties of the monopole antenna 106 because minimal current is induced at the ground plane 202. This minimal current is particularly present when the monopole antenna 106 is designed to have a high Q.

For example, the high Q monopole antenna 106 limits magnitudes of currents running into the ground plane 202. In this example, an amount of stored energy is proportional to the high Q and as such, near-field energy is stored in a smaller volume. The smaller volume limits electrical effects of the ground plane 202 and other components to the radiating properties of the monopole antenna 106. In other words, the resonant frequencies of the monopole antenna 106 are defined by their own configurations and independent of the size or shape of the ground plane 202.

At block 406, tuning one of the radiators in the radiating element is performed. For example, tuning one of the radiators (e.g., radiator 214) facilitates dual resonant frequency characteristics of the radiating element 200. In this example, the radiator 214 is coupled to a tuning capacitor 110 in order to resonate at the second resonant frequency. The second resonant frequency may include another resonant frequency that is different from the first resonant frequency in the radiator 212.

The following examples pertain to further embodiments:

Example 1 is an apparatus comprising: a feed-point; a radiating element electromagnetically coupled to the feed-point, the radiating element comprises: a first radiator coupled to the feed-point by electromagnetic coupling; a second radiator coupled to the first radiator; and a tuning capacitor coupled to the second radiator, wherein the tuning capacitor is configured to adjust an electrical length of the second radiator and change the electrical length of the first radiator.

In Example 2, the apparatus apparatus as recited in Example 1, wherein the feed-point indirectly feeds the radiating element through the electromagnetic coupling, wherein the electromagnetic coupling includes an electromagnetic response that defines a transfer of electrical energy from the feed-point to the radiating element.

In Example 3, the apparatus as recited in Example 1, wherein the electrical length of the first radiator is increased through meandering of the first radiator, wherein the meandered radiator has at least one end disposed to electromagnetically couple with the feed-point.

In Example 4, the apparatus as recited in Example 1, wherein the first radiator resonates at a first resonant frequency and the second radiator resonates at a second resonant frequency, wherein the first resonant frequency has a different frequency range from the second resonant frequency.

In Example 5, the apparatus as recited in Example 1, wherein the second radiator resonates at a second resonant frequency, the second resonant frequency is facilitated by adjustment of the tuning capacitor.

In Example 6, the apparatus as recited in any of Examples 1, 2, 3, 4, or 5, wherein the tuning capacitor is disposed at or near a tip of the second radiator.

In Example 7, the apparatus as recited in any of Examples 1, 2, 3, 4, or 5 further comprising a ground plane, wherein the second radiator and the ground plane are arranged to form a longitudinal area slot.

In Example 8, the apparatus as recited in any of Examples 1, 2, 3, 4, or 5 further comprising a ground plane, wherein an area is disposed between the second radiator and the ground plane.

Example 9 is a portable device comprising: a feed point; a radiating element coupled to the feed-point by electromagnetic coupling; and a tuning capacitor coupled to the radiating element.

In Example 10, the portable device as recited in Example 9, wherein the feed-point indirectly feeds the radiating element through the electromagnetic coupling between a first part of the radiating element and the feed-point, wherein the electromagnetic coupling includes an electromagnetic response that defines a transfer of electrical energies from the feed-point to the radiator.

In Example 11, the portable device as recited in Example 9, wherein an electrical length of the radiating element is increased without an increase in the size of the radiating element.

In Example 12, the portable device as recited in Example 9, wherein the radiating element comprises a first radiator and a second radiator forming a parallel oscillating path, wherein the first radiator resonates at a first resonant frequency and the second radiator resonates at a second resonant frequency, wherein the first resonant frequency has a different frequency range from the second resonant frequency.

In Example 13, the portable device as recited in any of Examples 9, 10, 11 or 12, wherein the radiating element has a radiator that is coupled to the tuning capacitor, wherein the tuning capacitor is disposed near a tip of the radiator.

In Example 14, the portable device as recited in any of Examples 9, 10, 11 or 12 further comprising a ground plane, wherein a radiator of the radiating element and the ground plane are arranged to form a longitudinal slot.

In Example 15, the portable device as recited in any of Examples 9, 10, 11 or 12 further comprising a ground plane, wherein an area is disposed in between a radiator of the radiating element and the ground plane.

Example 16 is a method of electrically tuning radiators in a portable device, the method comprising: combining a plurality of radiators to form a radiating element with a radiating behavior similar to a monopole antenna; feeding the radiating element through an electromagnetic coupling; electrically tuning the radiators.

In Example 17, the method as recited in Example 16, wherein feeding the radiating element includes indirect feeding by a feed-point of the radiating element, wherein the indirect feeding has an electromagnetic response that defines a transfer of electrical energy from the feed-point to the monopole antenna.

In Example 18, the method as recited in any of Examples 16 or 17, wherein feeding the radiating element includes positioning a part of the radiating element to electromagnetically couple with a feed-point.

In Example 19, the method as recited in any of Examples 16 or 17, wherein the radiating element comprises a first radiator and a second radiator, wherein the first radiator resonates at a first resonant frequency and the second radiator resonates at a second resonant frequency, wherein the first resonant frequency has a different frequency range from the second resonant frequency.

In Example 20, the as recited in any of claim 16 or 17, wherein the electrically tuning includes tuning of the radiators to resonate at dual resonance frequencies.

an apparatus comprising: a feed-point; a radiating element electromagnetically coupled to the feed-point, the radiating element comprises: a first radiator coupled to the feed-point by electromagnetic coupling; a second radiator coupled to the first radiator; and a tuning capacitor coupled to the second radiator, wherein the tuning capacitor adjusts an electrical length of the second radiator and increasing the electrical length of the first radiator.

In Example 2, the apparatus as recited in Example 1, wherein the feed-point indirectly feeds the radiating element through the electromagnetic coupling, wherein the electromagnetic coupling includes an electromagnetic response that defines a transfer of electrical energy from the feed-point to the radiating element.

In Example 3, the apparatus as recited in Example 1, wherein the electrical length of the first radiator is increased through meandering of the first radiator, wherein the meandered radiator has one end disposed to electromagnetically couple with the feed-point.

In Example 4, the apparatus as recited in Example 1, wherein the first radiator resonates at a first resonant frequency and the second radiator resonates at a second resonant frequency, wherein the first resonant frequency has a different frequency range from the second resonant frequency.

In Example 5, apparatus as recited in Example 1, wherein the second radiator resonates at a second resonant frequency, the second resonant frequency is facilitated by adjustment of the tuning capacitor.

In Example 6, apparatus as recited in any of Examples 1, 2, 3, 4, or 5, wherein the tuning capacitor is disposed at or near a tip of the second radiator.

In Example 7, apparatus as recited in any of Examples 1, 2, 3, 4, or 5 further comprising a ground plane, wherein a longitudinal slot is disposed between the second radiator and the ground plane.

In Example 8, the apparatus as recited in any of Examples 1, 2, 3, 4, or 5 further comprising a ground plane, wherein an area is disposed between the second radiator and the ground plane.

Example 9 is a portable device comprising: a feed point; a radiating element coupled to the feed-point by electromagnetic coupling; and a tuning capacitor coupled to the radiating element.

In Example 10, the portable device as recited in Example 9, wherein the feed-point indirectly feeds the radiating element through the electromagnetic coupling between one part of the radiating element and the feed-point, wherein the electromagnetic coupling includes an electromagnetic response that defines a transfer of electrical energies from the feed-point to the radiator.

In Example 11, the portable device as recited in Example 9, wherein an electrical length of the radiating element is increased without increase in the size of the radiating element.

In Example 12, the portable device as recited in Example 9, wherein the radiating element has a first radiator and a second radiator to form a parallel oscillating path, wherein the first radiator resonates at a first resonant frequency and the second radiator resonates at a second resonant frequency, wherein the first resonant frequency has a different frequency range from the second resonant frequency.

In Example 13, the portable device as recited in any of Examples 9, 10, 11 or 12, wherein the radiating element has a radiator that is coupled to the tuning capacitor, wherein the tuning capacitor is disposed near a tip of the radiator.

In Example 14, the portable device as recited in any of Examples 9, 10, 11 or 12 further comprising a ground plane, wherein a longitudinal slot is disposed between a radiator of the radiating element and the ground plane.

In Example 15, the portable device as recited in any of Examples 9, 10, 11 or 12 further comprising a ground plane, wherein an area is disposed in between a radiator of the radiating element and the ground plane.

Example 16 is a method of electrically tuning radiators in a portable device, the method comprising: combining of radiators to form a radiating element with a radiating behavior similar to a monopole antenna; feeding the radiating element through an electromagnetic coupling; electrically tuning the radiators.

In Example 17, the method as recited in Example 16, wherein feeding the radiating element includes indirect feeding by a feed-point of the radiating element, wherein the indirect feeding has an electromagnetic response that defines a transfer of electrical energy from the feed-point to the monopole antenna.

In Example 18, the method as recited in any of Examples 16 or 17, wherein feeding the radiating element includes positioning a part of the radiating element to electromagnetically couple with a feed point.

In Example 19, the as recited in any of Examples 16 or 17, wherein the radiating element has a first radiator and a second radiator wherein the first radiator resonates at a first resonant frequency and the second radiator resonates at a second resonant frequency, wherein the first resonant frequency has a different frequency range from the second resonant frequency.

In Example 20, the as recited in any of Examples 16 or 17, wherein the electrically tuning includes tuning of the radiators to resonate at dual resonance frequencies.

What is claimed is:

1. An apparatus, comprising:

a feed-point;

a monopole radiating element including (i) a first radiator configured to radiate at a first resonant frequency, the first radiator having a first end that is indirectly coupled to the feed-point via capacitive coupling, and (ii) a second radiator configured to resonate at a second resonant frequency different than the first resonant frequency, the second radiating element having a first end that is free of the capacitive coupling to the feed-point and a second end that is coupled to a second end of the first radiator; and a tuning capacitor coupled to the second radiator and disposed closer to the first end of the second radiator than to the second end of the second radiator, the tuning capacitor being configured to adjust the second resonant frequency of the second radiator, wherein the capacitive coupling between the feed-point and the first end of the first radiator is formed by a gap therebetween, wherein the second radiator and the ground plane are arranged to form a longitudinal slot in the space therebetween, and wherein the tuning capacitor and the longitudinal slot form a tank circuit to facilitate the generation of the second resonant frequency.

2. The apparatus as recited in claim 1, wherein the first radiator includes a meandering path between the first end of the first radiator and the second end of the first radiator.

3. The apparatus as recited in claim 1, wherein the tuning capacitor is coupled between the second radiator and the ground plane.

4. The apparatus of claim 1, wherein the adjustment of the second resonant frequency of the second radiator changes an operating bandwidth of the monopole radiating element.

5. The apparatus of claim 1, further comprising a ground plane, wherein the capacitive coupling between the feed-point and the first end of the first radiator substantially reduces induced currents in the ground plane, and wherein the first resonant frequency or the second resonant frequency is substantially independent on a change in size of the ground plane.

6. A method of electrically tuning radiators in a portable device, the method comprising:

coupling a first radiator to a second radiator to form a monopole radiating element, wherein the first radiator radiates at a first resonant frequency and has a first end that is indirectly coupled to a feed-point via a capacitive coupling, and wherein the second radiator radiates at a second resonant frequency that is different than the first resonant frequency and has a first end that is free of the capacitive coupling to the feed-point, and a second end that is coupled to a second end of the first radiator;

configuring a tuning capacitor that is coupled to the second radiator and disposed closer to the first end of the second radiator than to the second end of the second radiator, the second radiator and the ground plane being arranged to form a longitudinal slot in the space therebetween, wherein the tuning capacitor is configured to adjust the second resonant frequency of the second radiator, the tuning capacitor and the longitudinal slot forming a tank circuit to facilitate the generation of the second resonant frequency; and feeding the first end through the capacitive coupling, wherein the capacitive coupling between the feed-point and the first end of the first radiator is formed by a gap therebetween.

7. The method as recited in claim 6, wherein the coupling of the first radiator to the second radiator includes positioning a meandering path between the first end of the first radiator and the second end of the first radiator.

8. The method as recited in claim 6, further comprising:

adjusting a value of the tuning capacitor to change the second resonant frequency of the second radiator.

9. The method as recited in claim 8, wherein the act of adjusting the value of the tuning capacitor changes an operating bandwidth of the monopole radiating element.

10. The method as recited in claim 6, wherein feeding the first end via the capacitive coupling substantially reduces induced currents in a ground plane, wherein the first resonant frequency or the second resonant frequency is substantially independent on a change in size of the ground plane.

11. An inverted-L antenna (ILA), comprising:

an antenna feed;

a ground plane;

a first radiator configured to radiate at a first resonant frequency, the first radiator having a first end that is indirectly coupled to the antenna feed via capacitive coupling;

a second radiator forming a parallel oscillating path with the first radiator, the second radiator configured to resonate at a second resonant frequency different than the first resonant frequency, the second radiating element having a first end that is free of the capacitive coupling to the antenna feed; and a tuning capacitor coupled to the second radiator and disposed closer to the first end of the second radiator than to a second end of the second radiator, the tuning capacitor being configured to adjust the second resonant frequency of the second radiator, wherein the capacitive coupling between the antenna feed and the first end of the first radiator is formed by a gap therebetween, wherein the second radiator and the ground plane are arranged to form a longitudinal slot in the space therebetween, and wherein the tuning capacitor and the longitudinal slot form a tank circuit to facilitate the generation of the second resonant frequency.

12. The ILA as recited in claim 11, wherein the first radiator includes a meandering path between the first end of the first radiator and a second end of the first radiator.

13. The ILA as recited in claim 11, wherein the tuning capacitor is coupled between the second radiator and the ground plane.

14. The ILA as recited in claim 11 wherein the adjustment of the second resonant frequency of the second radiator changes an operating bandwidth of the ILA.

15. The ILA as recited in claim 11, wherein the capacitive coupling between the antenna feed and the first end of the first radiator substantially reduces currents in the ground plane, and wherein the first resonant frequency or the second resonant frequency is substantially independent on a change in size of the ground plane.

* * * * *